US008231739B2

(12) United States Patent
Ji et al.

(10) Patent No.: US 8,231,739 B2
(45) Date of Patent: Jul. 31, 2012

(54) METHOD FOR PRODUCING GRAIN-ORIENTED SILICON STEEL CONTAINING COPPER

(75) Inventors: Yaming Ji, Shanghai (CN); Huande Sun, Shanghai (CN); Guohua Yang, Shanghai (CN); Yongjie Yang, Shanghai (CN); Yunpeng Xu, Shanghai (CN); Changguo Huang, Shanghai (CN); Guobao Li, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 0 days.

(21) Appl. No.: 13/058,073

(22) PCT Filed: Apr. 24, 2009

(86) PCT No.: PCT/CN2009/071442

§ 371 (c)(1),
(2), (4) Date: Apr. 13, 2011

(87) PCT Pub. No.: WO2010/015156

PCT Pub. Date: Feb. 11, 2010

(65) Prior Publication Data

US 2011/0180187 A1 Jul. 28, 2011

(30) Foreign Application Priority Data

Aug. 8, 2008 (CN) ..... 2008 1 0041538

(51) Int. Cl.
*H01F 1/147* (2006.01)

(52) U.S. Cl. ..... 148/113; 148/111; 148/308

(58) Field of Classification Search ..... None
See application file for complete search history.

(56) References Cited

U.S. PATENT DOCUMENTS

| | | | | |
|---|---|---|---|---|
| 5,833,768 | A * | 11/1998 | Kosuge et al. | 148/111 |
| 6,280,534 | B1 * | 8/2001 | Senda et al. | 148/113 |
| 2004/0231752 | A1 * | 11/2004 | Nanba et al. | 148/111 |

FOREIGN PATENT DOCUMENTS

| | | |
|---|---|---|
| CN | 1148411 | 4/1997 |
| CN | 1400319 | 3/2003 |
| CN | 1611617 | 5/2005 |
| CN | 1612943 | 5/2005 |
| CN | 1786248 | 6/2006 |
| JP | 4-259329 | 9/1992 |
| JP | 6-256848 | 9/1994 |
| JP | 7-018457 | 1/1995 |
| JP | 8-134542 | 5/1996 |
| JP | 11-100616 | 4/1999 |
| KR | 20020074312 | 9/2002 |

OTHER PUBLICATIONS

International Search Report of PCT/CN2009/071442, dated Aug. 6, 2009 (4 pages).

* cited by examiner

*Primary Examiner* — John Sheehan
(74) *Attorney, Agent, or Firm* — Hamre, Schumann, Mueller & Larson, P.C.

(57) ABSTRACT

A method of manufacturing oriented Si steel containing Cu with high electric-magnetic property comprises: hot rolling slab; after first cold rolling, heating it to 800° C. or higher temperature and performing intermediate decarburization annealing in a protective atmosphere with $P_{H2O}/P_{H2}$ of 0.50~0.88 for 3-8 minutes, to decrease carbon content of the steel plate to less than 30 ppm; then peening and acid-pickling to remove oxide of Fe on surface and to control oxygen content to lower than 500 ppm; secondary cold rolling to final thickness and coating separation agent in water-slurry form; drying to decrease water content to lower than 1.5%; high-temperature annealing in a protective atmosphere containing hydrogen with oxidation degree ($P_{H2O}/P_{H2}$) of 0.0001-0.2; finally applying a tension coating and leveling tension annealing.

3 Claims, No Drawings

METHOD FOR PRODUCING GRAIN-ORIENTED SILICON STEEL CONTAINING COPPER

TECHNICAL FIELD

The invention relates to a method for producing grain-oriented silicon steel, particularly copper containing grain-oriented silicon steel with high electromagnetic performances.

BACKGROUND ART

Currently, the developmental trend of the processes for producing grain-oriented silicon steel is directed to heating of slab at relatively low temperature. A process for producing grain-oriented silicon steel at medium temperature using aluminum nitride and copper as inhibitors may realize the relatively low temperature for heating slab (1250-1300° C.). This process adopts double cold rollings with complete decarburizing annealing therebetween, wherein the complete decarburizing annealing (to reduce carbon to below 30 ppm) is carried out after the first cold rolling, and the resultant steel is rolled to the thickness of steel sheet with the second cold rolling before it is coated with MgO annealing separator as it is or after it is recovery annealed at low temperature, followed by high-temperature annealing and post treatment. In order to form complete glass film at the stage of high-temperature annealing, the conditions for decarburizing annealing in the process of heating slab at medium temperature have to be controlled strictly to form an appropriate oxide layer on the surface. However, the slab to be decarburizing annealed between the two cold rollings is rather thick. Under the decarburizing annealing conditions which can ensure formation of an appropriate oxide layer, carbon can not be reduced to below 30 ppm. Furthermore, the oxide layer on the surface is damaged during the second cold rolling after decarburizing annealing, throwing an impact on the surface quality.

In the art of grain-oriented silicon steel production, an underlying layer is known as a layer (such as $2MgO.SiO_2$) formed by reaction between an annealing separator layer (such as MgO) with oxide layer formed during decarburization. The underlying layer is also referred as "forsterite layer" or "glass film layer" in the art. In the production of grain-oriented silicon steel, it has always been difficult to form a good underlying layer that guarantees the tension effect and the insulating effect of tension coating. However, the unevenness at the joint of the underlying layer and the substrate may hinder magnetic domain activity, leading to an increase of iron loss. On the other hand, the existence of the glass film underlying layer results in poor stamping performance of the grain-oriented silicon steel. In order to further lower iron loss and improve stamping performance, grain-oriented silicon steel without underlying layer has been developed recently.

According to the method disclosed in Chinese Patent 03802019.X, the composition of the slab based on mass comprises Si 0.8~4.8%, C 0.003~0.1%, acid soluble Al 0.012-0.05%, N 0.01% or less than 0.01%, balanced by Fe and unavoidable inclusions. After hot rolling, the resultant hot rolled sheet is formed to the final thickness of the sheet via single cold rolling or two or more times of cold rollings with middle annealing therebetween as it is or after it is annealed. Subsequently, in an atmosphere with an oxidability that will not render formation of oxides of Fe family, the steel sheet is subjected to decarburizing annealing. After an oxide layer comprising silicon oxide as the main component is formed on the steel sheet surface, an annealing separator comprising aluminum oxide as the main component is coated to make a mirror-like surface of the annealed steel sheet. Secondary recrystallization is stabilized by controlling the moisture entrapped by the annealing separator which comprises aluminum oxide as the main component and is coated in the form of aqueous slurry and then dried, and by controlling the partial pressure of vapor during annealing the steel sheet.

According to the method disclosed in Korean Patent KR 526122, decarburization and nitridation are carried out concurrently in a process for producing silicon steel at low temperature, wherein magnesium oxide separator added with $SiO_2$ and Cl is used to avoid formation of an underlying layer during high-temperature annealing. This method is characterized by the following features. The composition of the billet based on weight comprises C 0.045-0.062%, Si 2.9-3.4%, P 0.015-0.035%, Als (acid soluble Al) 0.022-0.032%, Cu 0.012-0.021% N 0.006-0.009%, S 0.004-0.010%. The temperature at which the billet is heated is controlled in the range of 1150-1190° C. After cold rolled to the thickness of steel sheet, the steel sheet is decarburized and annealed at 840-890° C. in a protective atmosphere of wet nitrogen and hydrogen containing ammonia. A separator comprising 100 parts by weight of MgO+3-12 parts by weight of $SiO_2$+25 parts by weight of chloride ions as the main components is used for high-temperature annealing.

The above two patents are directed to grain-oriented silicon steel without underlying layer. They both use (Al, Si) N or AlN+MnS as inhibitors, and adopt a conventional high-temperature or low-temperature production process in which the billet is cold rolled to the thickness of steel sheet before decarburizing annealing, for the purpose of further lowering iron loss and improving stamping performance.

A continuous secondary recrystallization annealing process without inhibitors is disclosed in Chinese Patent CN 1400319, wherein the composition of molten steel based on weight comprises C 0.08% or less, Si 1.0-8.0%, Mn 0.005-3.0%; and the steel sheet is subjected to hot rolling, cold rolling, recrystallization annealing, secondary recrystallization annealing, decarburizing annealing and continuous high-temperature annealing sequentially. Grain-oriented electromagnetic steel sheet with high magnetic flux density and low iron loss is produced by this process without using inhibitors.

SUMMARY OF THE INVENTION

The object of the invention is to provide a method for producing grain-oriented silicon steel containing copper, wherein no underlying layer is formed during high-temperature annealing, and grain-oriented silicon steel with superior electromagnetic performances and surface quality is obtained.

The invention is realized by a process for producing grain-oriented silicon steel containing copper, comprising:

Secondary refining and continuous casting of molten steel in a converter or an electric furnace to obtain casting blank having the following composition based on weight: C 0.010%-0.050%, Si 2.5%-4.0%, Mn 0.1%-0.30%, Als 0.006%-0.030%, Cu 0.4%-0.7%, N 0.006%-0.012%, S≦0.025%, balanced by Fe and unavoidable inclusions;

Hot rolling, acid washing, primary cold rolling, degreasing and middle decarburizing annealing, wherein the resultant steel sheet is decarburizing annealed for 3-8 minutes at 800-900° C. in a protective atmosphere with $P_{H2O}/P_{H2}$=0.50-0.88 to reduce the carbon content in the steel sheet to 30 ppm or less;

Shot blasting and acid washing for removing iron oxides from the surface to control the oxygen content to be 500 ppm or less;

Acid washing and secondary cold rolling for rolling the steel sheet to desired thickness;

High-temperature annealing; and

Applying tension coating on the surface of the steel sheet and stretch-leveling annealing.

With respect to the high-temperature annealing process, the steel sheet is coated with a high-temperature annealing separator in the form of aqueous slurry after the secondary cold rolling and dried to reduce the water content of the separator to less than 1.5%, or dry coated directly by electrostatic coating; and then the steel sheet is high-temperature annealed in a protective atmosphere comprising hydrogen, wherein the oxidability ($P_{H2O}/P_{H2}$) of the protective atmosphere is in the range of 0.0001-0.2.

The main component of the high-temperature annealing separator is selected from any one of zirconia ceramic fine powder, alumina fine powder and silicon dioxide fine powder, or a combination of any two or three of zirconia ceramic fine powder, alumina fine powder and silicon dioxide fine powder.

The hot rolling, cold rolling and other processes in the invention are conventional technical means in the art. Specifically, the hot rolling is carried out by heating a slab in a heating furnace to above 1250° C. and holding this temperature for over 2 hours. It should be ensured that the rolling begins at 1050-1200° C., preferably 1070-1130° C., and ends at above 800° C., preferably above 850° C. The slab is finally rolled into a hot rolled sheet of 2.0-2.8 mm in thickness.

After the hot rolling, the resultant hot rolled sheet is acid washed, subjected to the primary cold rolling to obtain a medium thickness of 0.50-0.70 mm, and then degreased.

Subsequently, the decarburizing annealing and the secondary cold rolling are carried out. After the secondary cold rolling, the thickness of the steel sheet is 0.15-0.50 mm. And then, the steel sheet is degreased, annealed at high temperature, coated with the tension coating and stretch-leveling annealed.

According to the invention, any one of zirconia ceramic fine powder, alumina fine powder and silicon dioxide fine powder, or a combination of any two or three of zirconia ceramic fine powder, alumina fine powder and silicon dioxide fine powder is used as the main separator which does not react with the surface oxides during high-temperature annealing. The high-temperature annealing atmosphere is strictly controlled to allow reduction of the surface oxides at the stage of high-temperature annealing, wherein the surface oxides formed during decarburizing annealing comprise $SiO_2$ as the main component. Thus, a mirror-like final product without glass film is formed. After applying the tension coating, grain-oriented silicon steel with superior surface quality and magnetic performance is obtained. The method of the invention has thoroughly solved the problems such as unsteady quality, easy peeling of the surface coating, unconspicuous tension effect, poor insulation and surface quality that are encountered in conventional processes for heating slab at medium temperature.

The invention exhibits the following beneficial effects:

Since no glass film is formed during high-temperature annealing according to the method of the invention for producing grain-oriented silicon steel containing copper, decarburizing annealing atmosphere needn't to be strictly controlled to avoid formation of iron oxides. In other words, middle decarburizing annealing may be carried out at a relatively high oxidability ($P_{H2O}/P_{H2}$). Therefore, it may be ensured that the carbon content is lowered to 30 ppm or less due to an increase of decarburizing efficiency. Degradation of magnetic performance due to magnetic aging of the final product is thus avoided. On the other hand, the productive efficiency may be enhanced for the time of the middle decarburizing annealing is shortened.

According to the invention, shot blasting and acid washing are carried out after middle decarburizing annealing to remove the oxide layer comprising mainly iron oxides from the surface, and thus improve the surface quality of the slab after secondary cold rolling and that of the final product effectively. Since the separator is directly coated after secondary cold rolling to carry out high-temperature annealing, no recovery annealing is needed, so that problems such as degradation of magnetic performance and instability of the underlying layer are avoided, and productive efficiency is enhanced.

Since no underlying layer is formed during the high-temperature annealing according to the invention, there is no need to control the composition of the separator and the coating modes strictly, so that the production stability is enhanced and the purifying effect of steel is improved effectively. A mirror-like final product is obtained, which has no oxide layer on the steel sheet surface and unevenness of the glass film that hinder magnetic domains from moving. Therefore, iron loss is decreased significantly.

In summary, the invention provides a method for producing grain-oriented silicon steel sheet with low cost, high efficiency and good feasibility, which not only inherits the advantages of heating slab at medium temperature, but also effectively solves the problems such as insufficient decarburization, degradation of magnetic performance due to recovery annealing, poor adhesion of the coating, unconspicuous tension effect and poor surface quality that exist in the process for heating slab at medium temperature.

DETAILED DESCRIPTION OF THE INVENTION

Example 1

Steel was smelted in a 500 kg vacuum furnace. The chemical composition (wt %) of the slab comprised 0.035% C, 3.05% Si, 0.020% S, 0.008% Als, 0.0010% N, 0.60% Cu, 0.15% Mn, balanced by Fe and unavoidable inclusions. The slab of this composition was hot rolled by heating it to 1280° C. and holding this temperature for 3 hours. The rolling was ended at 930-950° C. After rolling, the resultant steel was cooled by laminar flow, and then coiled at 550° C.±30° C. to form band steel of 2.5 mm in thickness. After shot blasting and acid washing, the band steel was cold rolled to a thickness of 0.65 mm and then subjected to middle annealing to reduce carbon to 30 ppm or less. After shot blasting and acid washing, three processes are carried out respectively.

(1) The band steel was subjected to secondary cold rolling to 0.30 mm, the thickness of the final product, coated with an annealing separator comprising $Al_2O_3$ slurry as the main component and dried. Thereafter, the steel band was coiled and subjected to high-temperature annealing in an atmosphere of mixed nitrogen and hydrogen or pure hydrogen at 1200° C. which was held for 20 hours. After uncoiled, the steel band was coated with insulating coating and stretch-leveling annealed.

(2) The band steel was subjected to secondary cold rolling to 0.30 mm, the thickness of the final product, coated with an annealing separator comprising MgO as the main component. Thereafter, the steel band was coiled and subjected to high-temperature annealing in an atmosphere of mixed nitrogen and hydrogen or pure hydrogen at 1200° C. which was held for 20 hours. After uncoiled, the steel band was coated with insulating coating and stretch-leveling annealed.

(3) The band steel was subjected to secondary cold rolling to 0.30 mm, the thickness of the final product, annealed at 700° C. in a wet atmosphere of nitrogen and hydrogen, coated with an annealing separator comprising MgO as the main component. Thereafter, the steel band was coiled and subjected to high-temperature annealing in an atmosphere of mixed nitrogen and hydrogen or pure hydrogen at 1200° C. which was held for 20 hours. After uncoiled, the steel band was coated with insulating coating and stretch-leveling annealed.

The magnetic and coating performances of the resultant products are shown in Table 1.

TABLE 1

| | Magnetic Performances | | Insulating Coating Performances of Final Product | | |
|---|---|---|---|---|---|
| Process | $B_8$, T | $P_{17/50}$, W/kg | Adhesion | Coating Appearance | Description |
| (1) | 1.888 | 1.128 | B | good, even | Inventive Example |
| (2) | 1.862 | 1.232 | E | uneven, with crystals exposed from the underlying layer | Comparative Example |
| (3) | 1.762 | 1.582 | F | uneven | Comparative Example |

Example 2

Steel was smelted in a 500 kg vacuum furnace. The chemical composition (wt %) of the slab comprised 0.032% C, 3.15% Si, 0.016% S, 0.012% Als, 0.0092% N, 0.48% Cu, 0.20% Mn, balanced by Fe and unavoidable inclusions. The slab of this composition was hot rolled by heating it to 1280° C. and holding this temperature for 3 hours. The rolling was ended at 930-950° C. After rolling, the resultant steel was cooled by laminar flow, and then coiled at 550° C.±30° C. to form band steel of 2.5 mm in thickness. After shot blasting and acid washing, the band steel was cold rolled to a thickness of 0.65 mm and then subjected to middle annealing at 850° C. under the conditions given in Table 2. After shot blasting and acid washing, the band steel was subjected to secondary cold rolling to 0.30 mm, the thickness of the final product, coated with an annealing separator comprising $Al_2O_3$ slurry as the main component and dried. Thereafter, the steel band was coiled and subjected to high-temperature annealing in an atmosphere of mixed nitrogen and hydrogen or pure hydrogen at 1200° C. which was held for 20 hours. After uncoiled, the steel band was coated with insulating coating and stretch-leveling annealed. The magnetic and coating performances of the resultant products are shown in Table 2, wherein the adhesion was evaluated according to the method and standard defined in National Standards GB/T 2522-1988.

TABLE 2

| Middle Annealing Conditions | | Final Product | Magnetic Performances | | Insulating Coating Performances of Final Product | | |
|---|---|---|---|---|---|---|---|
| $P_{H2O}/P_{H2}$ | Time | [C] | $B_8$, T | $P_{17/50}$, W/kg | Adhesion | Coating Appearance | Description |
| 0.88 | 5 min | 20 ppm | 1.905 | 1.012 | B | good, even | Inventive Example |
| 0.88 | 4 min | 28 ppm | 1.886 | 1.040 | B | good, even | Inventive Example |
| 0.80 | 5 min | 21 ppm | 1.897 | 1.022 | B | good, even | Inventive Example |
| 0.65 | 5 min | 22 ppm | 1.892 | 1.028 | B | good, even | Inventive Example |
| 0.60 | 5 min | 25 ppm | 1.888 | 1.036 | B | good, even | Inventive Example |
| 0.50 | 5 min | 30 ppm | 1.880 | 1.062 | B | good, even | Inventive Example |
| 0.40 | 5 min | 35 ppm | 1.796 | 1.320 | B | good, even | Comparative Example |
| 0.40 | 6 min | 30 ppm | 1.860 | 1.160 | B | good, even | Comparative Example |
| 0.40 | 8 min | 25 ppm | 1.870 | 1.084 | B | good, even | Comparative Example |

Example 3

Steel was smelted in a 500 kg vacuum furnace. The chemical composition (wt %) of the slab comprised 0.032% C, 3.15% Si, 0.016% S, 0.012% Als, 0.0092% N, 0.48% Cu, 0.20% Mn, balanced by Fe and unavoidable inclusions. The slab of this composition was hot rolled by heating it to 1280° C. and holding this temperature for 3 hours. The rolling was ended at 930-950° C. After rolling, the resultant steel was cooled by laminar flow, and then coiled at 550° C.±30° C. to form band steel of 2.5 mm in thickness. After shot blasting and acid washing, the band steel was cold rolled to a thickness of 0.65 mm and then subjected to middle annealing at 850° C. under the conditions given in Table 3. After shot blasting and acid washing, the band steel was subjected to secondary cold rolling to 0.30 mm, the thickness of the final product, coated with an annealing separator comprising $Al_2O_3$ slurry as the main component and dried. Thereafter, the steel band was coiled and subjected to high-temperature annealing in an atmosphere of mixed nitrogen and hydrogen or pure hydrogen at 1200° C. which was held for 20 hours. After uncoiled, the steel band was coated with insulating coating and stretch-leveling annealed. The magnetic and coating performances of the resultant products are shown in Table 3.

TABLE 3

| Middle Annealing Conditions | | Secondary Cold | Magnetic Performances | | Insulating Coating Performances of Final Product | | |
|---|---|---|---|---|---|---|---|
| $PH_2O/PH_2$ | Time | Rolling Process | $B_8$, T | $P_{17/50}$, W/kg | Adhesion | Coating Appearance | Description |
| 0.88 | 5 min | shot blasting, acid washing + cold rolling | 1.902 | 1.016 | B | good, even | Inventive Example |
| 0.85 | 5 min | shot blasting, acid washing + cold rolling | 1.896 | 1.024 | B | good, even | Inventive Example |
| 0.65 | 5 min | shot blasting, acid washing + cold rolling | 1.892 | 1.028 | B | good, even | Inventive Example |
| 0.88 | 5 min | direct secondary cold rolling | 1.896 | 1.120 | D | uneven | Comparative Example |
| 0.85 | 5 min | direct secondary cold rolling | 1.894 | 1.122 | C | uneven | Comparative Example |
| 0.64 | 5 min | direct secondary cold rolling | 1.889 | 1.132 | C | good, even | Comparative Example |

Example 4

Steel was smelted in a 500 kg vacuum furnace. The chemical composition (wt %) of the slab comprised 0.032% C, 3.15% Si, 0.016% S, 0.012% Als, 0.0092% N, 0.48% Cu, 0.20% Mn, balanced by Fe and unavoidable inclusions. The slab of this composition was hot rolled by heating it to 1280° C. and holding this temperature for 3 hours. The rolling was ended at 930-950° C. After rolling, the resultant steel was cooled by laminar flow, and then coiled at 550° C.±30° C. to form band steel of 2.5 mm in thickness. After shot blasting and acid washing, the band steel was cold rolled to a thickness of 0.65 mm and then subjected to middle annealing at 850° C. under the conditions given in Table 4. After shot blasting and acid washing, the band steel was subjected to secondary cold rolling to 0.30 mm, the thickness of the final product, electrostatically coated with an annealing separator comprising $Al_2O_3$ as the main component. Thereafter, the steel band was coiled and subjected to high-temperature annealing in an atmosphere of mixed nitrogen and hydrogen or pure hydrogen at 1200° C. which was held for 20 hours. After uncoiled, the steel band was coated with insulating coating and stretch-leveling annealed. The magnetic and coating performances of the resultant products are shown in Table 4.

TABLE 4

| Middle Annealing Conditions | | Magnetic Performances | | Insulating Coating Performances of Final Product | | |
|---|---|---|---|---|---|---|
| $PH_2O/PH_2$ | Time | $B_8$, T | $P_{17/50}$, W/kg | Adhesion | Coating Appearance | Description |
| 0.88 | 5 min | 1.904 | 1.010 | B | good, even | Inventive Example |
| 0.88 | 4 min | 1.885 | 1.041 | B | good, even | Inventive Example |
| 0.80 | 5 min | 1.895 | 1.024 | B | good, even | Inventive Example |
| 0.65 | 5 min | 1.890 | 1.029 | B | good, even | Inventive Example |
| 0.60 | 5 min | 1.886 | 1.037 | B | good, even | Inventive Example |

Example 5

Steel was smelted in a 500 kg vacuum furnace. The chemical composition (wt %) of the slab comprised 0.032% C, 3.15% Si, 0.016% S, 0.012% Als, 0.0092% N, 0.48% Cu, 0.20% Mn, balanced by Fe and unavoidable inclusions. The slab of this composition was hot rolled by heating it to 1280° C. and holding this temperature for 3 hours. The rolling was ended at 930-950° C. After rolling, the resultant steel was cooled by laminar flow, and then coiled at 550° C.±30° C. to form band steel of 2.5 mm in thickness. After shot blasting and acid washing, the band steel was cold rolled to a thickness of 0.65 mm and then subjected to middle annealing at 850° C. under the conditions given in Table 5. After shot blasting and acid washing, the band steel was subjected to secondary cold rolling to 0.30 mm, the thickness of the final product, coated with an annealing separator comprising $ZrO_2$ slurry as the main component and dried or electrostatically coated directly with an annealing separator comprising $ZrO_2$ fine powder as the main component. Thereafter, the steel band was coiled and subjected to high-temperature annealing in an atmosphere of mixed nitrogen and hydrogen or pure hydrogen at 1200° C. which was held for 20 hours. After uncoiled, the steel band was coated with insulating coating and stretch-leveling annealed. The magnetic and coating performances of the resultant products are shown in Table 5.

TABLE 5

| Middle Annealing Conditions | | Coating Mode | Magnetic Performances | | Insulating Coating Performances of Final Product | | |
|---|---|---|---|---|---|---|---|
| $PH_2O/PH_2$ | Time | of Separator | $B_8$, T | $P_{17/50}$, W/kg | Adhesion | Coating Appearance | Description |
| 0.88 | 5 min | slurry coating | 1.905 | 1.012 | B | good, even | Inventive Example |
| 0.80 | 5 min | slurry coating | 1.897 | 1.026 | B | good, even | Inventive Example |
| 0.65 | 5 min | slurry coating | 1.892 | 1.029 | B | good, even | Inventive Example |
| 0.88 | 5 min | electrostatic coating | 1.898 | 1.019 | B | good, even | Inventive Example |
| 0.80 | 5 min | electrostatic coating | 1.895 | 1.025 | B | good, even | Inventive Example |
| 0.65 | 5 min | electrostatic coating | 1.893 | 1.026 | B | good, even | Inventive Example |

According to the invention which inherits the advantages of heating slab at medium temperature, the process in which no underlying layer is formed during high-temperature annealing is utilized, and the decarburizing annealing process and the high-temperature annealing process are controlled strictly, so that mirror-like grain-oriented silicon steel without underlying layer is obtained. The final product with tension coating has good appearance and electromagnetic characteristics, and enhanced stamping performance. The method of the invention has reduced procedures and enhanced productive efficiency, and produces products with stable performances. The devices used herein are conventional devices for producing grain-oriented silicon steel, wherein the technologies and control means are simple and practical.

The invention claimed is:

1. A method for producing grain-oriented silicon steel containing copper, comprising:

secondary refining and continuous casting of molten steel in a converter or an electric furnace to obtain a casting blank having the following composition based on weight: C 0.010%-0.050%, Si 2.5%-4.0%, Mn 0.1%-0.30%, acid soluble Al (Als) 0.006%-0.030%, Cu 0.4%-0.7%, N 0.006%-0.012%, S≦0.025%, balanced by Fe and unavailable inclusions;

forming a hot rolled sheet by hot rolling the casting blank;

acid washing the hot rolled sheet;

forming a cold rolled sheet by primary cold rolling the hot rolled sheet;

degreasing the cold rolled sheet;

middle decarburizing annealing the cold rolled sheet, wherein the middle decarburizing annealing is carried out by heating the cold rolled sheet to 800° C. or higher in a protective atmosphere with $P_{H2O}/P_{H2}$=0.50-0.88 for 8 minutes or shorter to reduce the carbon content to 30 ppm or less;

shot blasting and acid washing for removing iron oxides from a surface of the cold rolled sheet to control the oxygen content to be 500 ppm or less;

forming a steel sheet by secondary cold rolling the cold rolled sheet to a desired thickness;

high-temperature annealing the steel sheet; and applying tension coating on the surface of the steel sheet and stretch-leveling annealing the steel sheet.

2. The method of claim 1 for producing grain-oriented silicon steel containing copper, wherein in the step of high-temperature annealing, the steel sheet is coated with a high-temperature annealing separator in the form of aqueous slurry after the secondary cold rolling and dried to reduce the water content of the separator to less than 1.5%, or dry coated directly by electrostatic coating; and the steel sheet is high-temperature annealed in a protective atmosphere comprising hydrogen, wherein the oxidability ($P_{H2O}/P_{H2}$) of the protective atmosphere is in the range of 0.0001-0.2.

3. The method of claim 2 for producing grain-oriented silicon steel containing copper, wherein a main component of the high-temperature annealing separator is selected from any one of zirconia ceramic fine powder, alumina fine powder and silicon dioxide fine powder, or a combination of any two or three of zirconia ceramic fine powder, alumina fine powder and silicon dioxide fine powder.

* * * * *